US006068239A

United States Patent [19]

Palacio

[11] Patent Number: 6,068,239

[45] Date of Patent: May 30, 2000

[54] VEHICLE JACK

[75] Inventor: Joseba Palacio, Santurtzi, Spain

[73] Assignee: Batz, S. Coop. Ltda., Igorre, Spain

[21] Appl. No.: 08/940,016

[22] Filed: Sep. 29, 1997

[30] Foreign Application Priority Data

Sep. 27, 1997 [ES] Spain ..... 9602045

[51] Int. Cl.[7] ..... B66F 3/00

[52] U.S. Cl. ..... 254/126; 254/124

[58] Field of Search ..... 254/124, 126, 254/7 B, 100

[56] References Cited

U.S. PATENT DOCUMENTS

| | | | |
|---|---|---|---|
| 3,989,225 | 11/1976 | Keilholz | 254/126 |
| 4,093,182 | 6/1978 | Rutenbeck | 254/126 |
| 5,011,118 | 4/1991 | Brosius | 254/126 |
| 5,184,806 | 2/1993 | Erschens et al. | 254/126 |
| 5,275,378 | 1/1994 | Alten | 254/126 |
| 5,685,659 | 11/1997 | Brosius et al. | 254/126 |

FOREIGN PATENT DOCUMENTS

| | | | |
|---|---|---|---|
| 0232836 | 8/1987 | European Pat. Off. . | |
| 0332565 | 9/1989 | European Pat. Off. . | |
| 0636571 | 2/1995 | European Pat. Off. . | |
| 0683130 | 11/1995 | European Pat. Off. . | |
| 0697365 | 2/1996 | European Pat. Off. . | |
| 0734997 | 10/1996 | European Pat. Off. . | |
| 542224-A1 | 11/1991 | France | 254/126 |
| 2273752 | 1/1976 | Germany | 254/126 |
| 2621426 | 11/1977 | Germany | 254/126 |
| 2290070 | 12/1995 | United Kingdom . | |

*Primary Examiner*—David A. Scherbel
*Assistant Examiner*—Daniel G. Shanley
*Attorney, Agent, or Firm*—Browdy and Neimark

[57] ABSTRACT

A vehicle jack of the type known as "Y-jacks". It has a base plate (1) with perforated fins that receive and fix, in a particular way, the protruding necks on the wings of the jack body. A nut (13) is secured to the end of the body, with easy entrance into the end and fixed by some lugs (14) which are bent over the central portion of the nut. The arm (3) of jack also has two protruding necks towards the interior, on which a cross member is received, formed by a part with a U-shaped section whose wings or sides clasp on to the necks, are made with U-shaped openings. The base of the cross member is controlled by a special easy entrance holder plate on the housing on the arm. An arm (30) of a specially designed shape acts in combination with a holder plate-cross member, whose seating for the vehicle has a metal insert. This holder plate-cross member is provided with an external retainer on which the end of the screw spindle is supported. These features eliminate conventional parts and provide for fast efficient assemble of the different components.

13 Claims, 9 Drawing Sheets

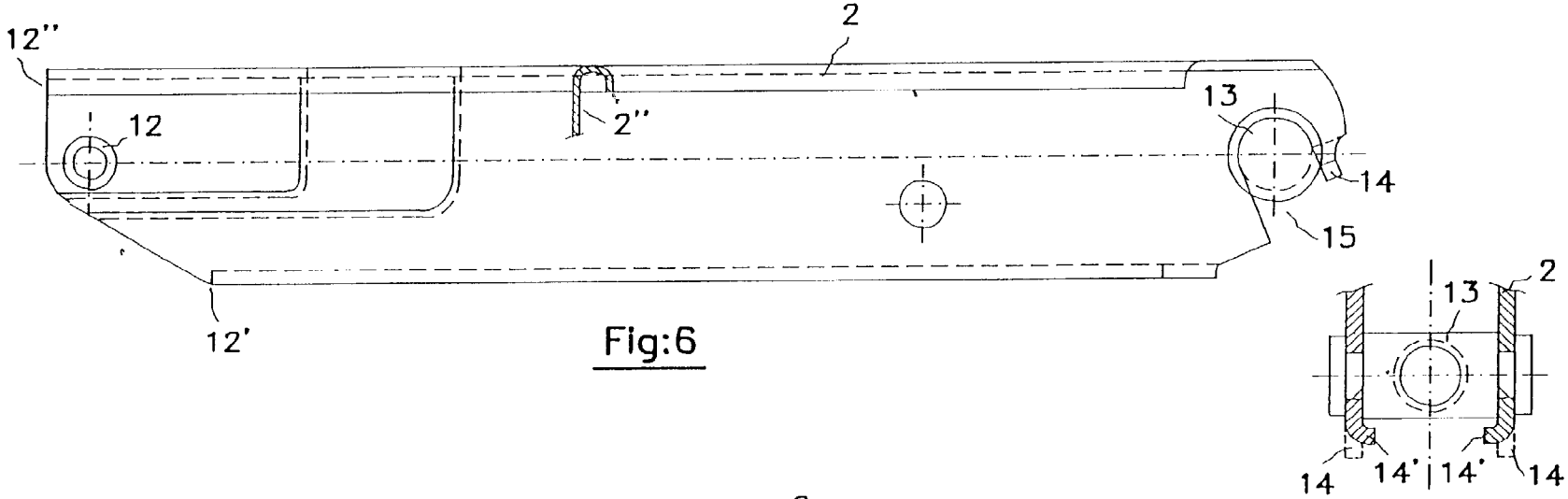
Fig:6
Fig:8
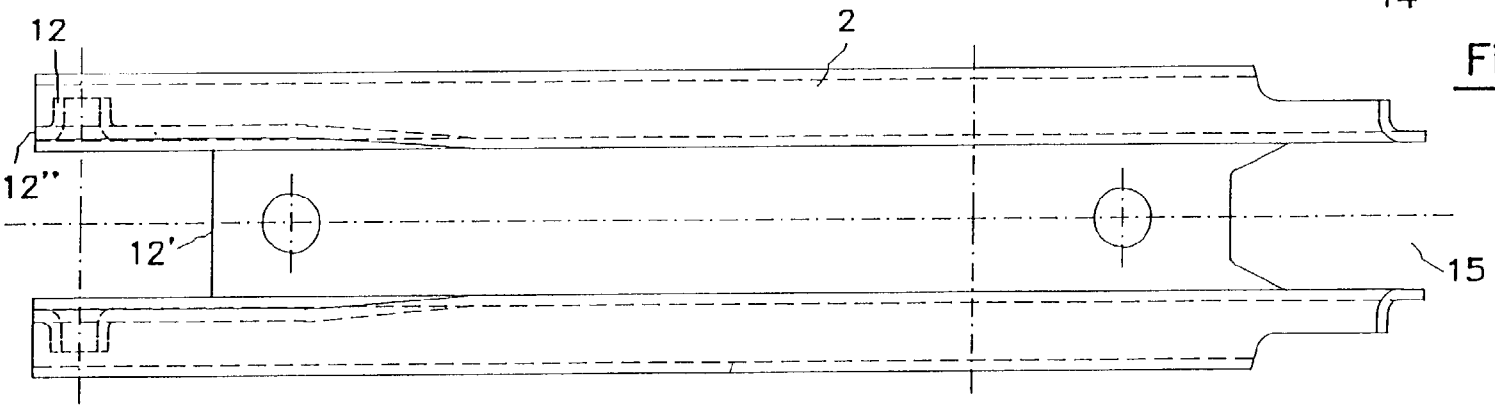
Fig:7

VEHICLE JACK

BACKGROUND OF THE INVENTION

1. Technical Field of the Invention

The invention relates to a vehicle jack, applicable especially to jacks of the type known as Y-jacks, which is composed of a base to act as a support on the ground, a first member or body which is connected to the said base body and rotates on it; a second member or arm that rotates on the body; a threaded screw spindle that connects together the body and the arm and which is operated by a winding handle.

The upper end of the body receives a nut through which the threaded screw spindle passes and extends until the arm, on which a cross member is situated receives the end of the said screw spindle.

The lower end of the arm rotates on the body by means of a pin, and its upper end includes a holder plate on which the edge of the vehicle body is supported.

In certain solutions for jacks of this type, the cross member and the holder plate can consist of one single part.

2. Prior Art

Though patent EP-A-0332565 a jack is known which is provided with a base plate for support on the ground and provided with facing side elevations with holes, in the shape of inwardly protruding necks, into which facing holes made in the wings of the U-shaped section of the body or leg fit, so that the necks of the base body are received in the holes in the body, performing the function of the mutual rotation axis between both parts.

In the same way, through this document, the existence is known of two raised stops in the centre of the base plate, one of which acts to provide an inclination to the body at the start of raising, while the aim of the other is to limit the inclination of the body in the maximum elevation of the jack.

In an almost similar manner to the provision of the holes and necks in the body and in the base plate, as has been described, document EP-A-0621230 carries out this same function based on altering the arrangement of the two items, i.e. some facing protruding bodies on the wings or sides of the body and two facing holes in the elevations on the base plate.

These known techniques have the disadvantage arising from the assembly between the body and the base plate, which means the application of a series of operations that make the assembly process more costly, and on which the formal constitution of the base plate itself has an influence, as will be explained later.

With regard to the nuts, units are known which are formally established by some cylindrical elements provided with a central area of greater diameter and with a hole for the screw spindle to pass though and continue to the start of the winding handle, on whose sides annular slots are established in order to receive the thickness of the wings of the body, with some outer ends of greater diameter which are supported on the outer surfaces of the said wings. These nuts, already known in themselves, are fixed to the body, once inserted, by various means, usually bothersome and involving a certain amount of complication in assembly.

Through document EP-A-0683130, for example, a holder plate is known that receives the thickness of a protuberance on the body of the vehicle in a recess with which it is provided, with this holder plate being situated at the free end of the jack arm and housed by means of recesses made in the wings of the U-shape of which the said arm is formed. This holder plate is provided with some annular slots close to its longitudinal ends, in which the thicknesses of the arm are received, and its rotation in the recess in the said arm is limited by some outer prongs that it is provided with.

In general, these holder plates are usually assembled in a complicated manner in the recesses in the arm, given that they usually turn in order to provide their entry and then turn again for their final emplacement.

Also known through EP-A-01636571 is a cross member that takes in the end of the screw spindle through some washers and a ball cage. In this reference, an item prior to the washer and ball cage is controlled in its position by means of two side lugs protruding from the sides of some widenings of the arm, which are bent after the arrangement of the said prior item or cross member.

The disadvantages of this arrangement lie in its arduous assembly and the relative resistance of the cross member itself Also known, through document EP-A-0697365, is a holder plate-cross member that carries out the double function of taking in the end of the threaded screw spindle and, moreover, receiving the bodywork of the vehicle. The end washers and ball cage are included in a closed housing at the outer end of the holder plate-cross member.

In some cases, these holder plate-cross members are made of metal, with the disadvantages of their excessive rigidity, a considerable cost and an assembly also of a certain importance, as well as their lack of elasticity.

When these holder plates are manufactured in plastic material, the disadvantages that they have consist of complicated assembly and problems of breakage of the seating for the vehicle body.

OBJECTIVES AND SUMMARY OF THE INVENTION

Against these known techniques, this invention presents a vehicle jack with the following objectives which are claimed in the invention:

1—A base plate connected to a body, which is formed by a part that noticeably facilitates the assembly and insertion of the body into the base plate.

2—A body with an upper recess for the insertion of the nut for the screw spindle, carried out in such a way that it permits the placement of the nut in a very easy manner in the insertion and fixing.

3—An arm with a U-shaped cross section for fast assembly with the cross member of the screw spindle, which is housed and seated on the said arm and controlled in its simple positioning.

4—A holder plate that enter directly into the end of the arm with a slight pressure and becomes situated in a stable manner.

5—A holder plate-cross member made of plastic material with fast assembly in relation to the arm and to the threaded screw spindle and with a durable seating for the vehicle body.

6—A specially narrow arm that manages to obtain a greater mechanical performance.

In order to achieve the first of the objectives, the base plate is made starting from a metal part on which four lower protuberances are formed by way of legs that occupy the corners of the base plate, a perimetral edge and some upward protuberances protruding from the base in a transversal direction. The perimetral edge forms evenly separated elevations on the X—X axis, on which facing perforated holes are made. These two elevations each have notches, by which each of the elevations is bent towards the exterior of the base plate, leaving the perforations open, at least partially.

The upper protuberances on the base are situated approximately between the separated elevations with holes, and the whole assembly of the base plate has the advantageous particularity that it is symmetrical in relation to the X, Y and Z axes, with which correct positioning is facilitated for assembly purposes.

For its part, the body, which consists of a U-shaped section profile, is provided with protruding necks from its wings close to its end, more precisely at the end not provided with a base to fit with the perforations in the elevations of the base plate.

In the assembly, these necks are situated directly on the open perforations (bent) of the side elevations of the base plate, so that later it is possible to proceed with the bending or folding of the elevations, which is facilitated by the notches that the elevations are provided with. The method of bending or folding the elevations is carried out by any conventional mechanical means.

In particular, the four lower protuberances, by way of legs, are usually round and, at the most, provided with a protruding point, whose attainment is doubtful with conventional tooling, with the aim of providing a better grip on the ground.

According to this aspect of the invention, the protuberances by way of legs are made based on cuts in the material of the base plate itself, which, logically, give rise to downward edges, with which the grip on the ground of the said base plate is considerably increased.

The edges in question, as will be observed later in relation to the drawings which are included, are arranged counter positioned as regards the rotation axis of the body on the base plate.

The second objective of the invention is achieved by providing, in the two recesses in the wings at the upper end of the body, of some oversized protuberances. The recesses in question allow the simple entry of the annular slots of the nut in which the thicknesses of the wings of the body are received. Once this fitting has been carried out, the ends of the said oversized protuberances are bent by any means towards the central portion of the nut, of a greater diameter, thus perfectly securing the nut.

The lower end body of the body in which the two necks are provided for their connection to the base plate limits their maximum and minimum rotation movements on the base plate. At the start of the elevation, the end of the base of the body makes contact with one of the ribs on the base of the base plate, so that it provides a certain inclination to the body in this said start.

At the end of the elevation of the jack, the free ends of the wings on the body make contact with the perimetral ledge on the base plate, logically on the other side of the central elevation in relation to the rib on the base mentioned above.

In order to increase the strength of the body, its longitudinal edges are provided with outward beads or lips that finally extend parallel to the surfaces of the wings, adopting an inverted U shape.

The third objective of the invention is obtained by means of the combination of some internal protuberances by way of necks made on the wings of the arm close to the recess in which the holder plate is housed, and a cross member through which the screw spindle passes.

For this, the cross member is made based on a U-shaped part, whose base is provided with hole for the screw spindle to pass through and whose wings have some U-shaped recesses in a longitudinal direction, open towards the free ends of the said wings.

The screw spindle passes through the hole in the base, and the U-shaped recesses in the cross member are simply accommodated on the internal necks of the arm. The exterior of the base of the cross member receives the washers and conventional ball cage, for example, with which the said surface acts as a seating for the closure of the end of the screw spindle.

The body of the holder plate that is housed in the end recesses of the arm remains close to and acts as a natural stop for the cross member, so that the cross member is supported on the holder plate and does not need any other type of elements to ensure its immobility.

The cross member can consist of a part just like the one described or any other, with the determining particularity of having a centred longitudinal perforation for the passage of the screw spindle, some open lateral recesses of sufficient depth to receive the necks on the arm and a base to act as a support for the closure of the end of the screw spindle.

Therefore, a monoblock part with these characteristics can be used, as will be observed later in relation with the drawings which are attached.

In any case, the simplicity of this solution is pointed out, as well as its immediate assembly, which is not subject to more than the simple insertion of the cross member.

With regard to the washers and the ball cage that make up the closure for the screw spindle on the outer base surface of the cross member, we point out that the invention also claims the replacement of the ball cage by an anti-friction material, for example a metal plate coated on both sides with any kind of friction proof material.

The holder plate which is the object of the fourth objective of the invention is, in general terms, similar to the one mentioned in the previously stated EP-A-0683120, with the advantageous particularity that its housing in the recesses in the wings of the arm is carried out in a simple, easy manner, making it impossible for it to come out on its own once it has been positioned.

For this, the holder plate is provided with some annular slots or channels, already mentioned, in order to receive the thicknesses of the recesses on the arm. The holder plate also has two pairs of longitudinal slots which extend from the sides to the annular slots. Both pairs of longitudinal slots are made in diametrically opposing positions, with each one occupying a portion of circular arc on both sides of the vertical of the recess that receives the bodywork of the vehicle.

Moreover, in the position of the two pairs of longitudinal slots, pairs of protruding centred portions by way of ribs are arranged in the annular slots, so that when the longitudinal slots circulate below the ribs, (at least partially), they act as springs which are capable of being pressed to return to their position, i.e. recovering their initial position.

Obviously, the ribs remain in the same position as the slots, diametrically opposed and on both sides of the vertical of the recess for the bodywork, so that when the holder plate is housed, it is on the recess in the arm, exerting a certain pressure on it so that the ribs flex and allow it to become totally housed, while later maintaining the pressure against the thicknesses of the recesses in the arm and preserving the fit firmly without interfering in the rotation of the holder plate.

The fifth objective, referring to the holder plate-cross member, is achieved by providing a part made of suitable plastic material, which has, like in the already mentioned EP-A-0697365, a prolongation towards the screw-spindle which is perforated axially until the opposite end in order to receive the screw spindle.

At the other longitudinal end, it is provided with an L-shaped projection, whose vertical wing faces the prolongation of the axial perforation and is determined with a centred U-shaped cavity whose centre coincides with that of the said perforation. This wing remains a certain distance from the body of the part, providing a space in which the washers and ball cage or washers and anti-friction material that close the free end of the screw spindle are situated, thus providing it with a certain flexibility.

The central portion of the holder plate-cross member has an upward projection on which the seating for the vehicle bodywork is formed, in a longitudinal recess that to the screw spindle engaged in the holder plate cross member. In this portion, a metal insert is situated, at least partially, which is provided on its unseen side with a series of ledges or ribs of any shape, which become embedded in the plastic material in order to ensure its perfect fastening.

A holder plate-cross member carried out as described has a good level of elasticity, better assembly and a perfect seating for the vehicle bodywork, which prevents breakages and increases its working life.

The final objective of the invention, which is the arrangement of a specially narrow arm, can be combined with the base plate, body, nut and holder plate-cross member and is achieved by providing an element with a U-shaped cross section. whose base has an clear outward concavity along its whole length, with the particularity that the centre point, approximately, of the said curved area is close to the theoretical line that joins the centres of the ends on which the recesses are prepared for the holder plate and two holes for the positioning of the nut.

This new shaping of the arm leads to it being able to reduce, by a certain amount, the thickness of the profile that it is made of, for example from 2.5 to 1.5 millimetres, with which the saving on the weight of the arm is substantial. In the same way, the material, which always works under compression in this case, now does this in a more satisfactory manner.

A factor which also collaborates in this is the incorporation of a rib at the longitudinal ends of the arm, which is established with a certain upward inclination and outward from the wings of the arm.

BRIEF DESCRIPTION OF THE DRAWINGS

All these and other explanatory details of the invention will be understood with greater clarity with reference to the accompanying sheets of drawings, in which the following are represented, with a non-restrictive nature.

FIG. 6 is an elevation of the body, in accordance with the invention.

FIG. 7 is the top view of the body of FIG. 6.

FIG. 8 represents the upper end of the body with its fins folded over the nut for the passage of the screw spindle, in the assembled position.

DETAILED DESCRIPTION OF THE PREFERRED EMBODIMENT(S) OF THE INVENTION

Figure 1:
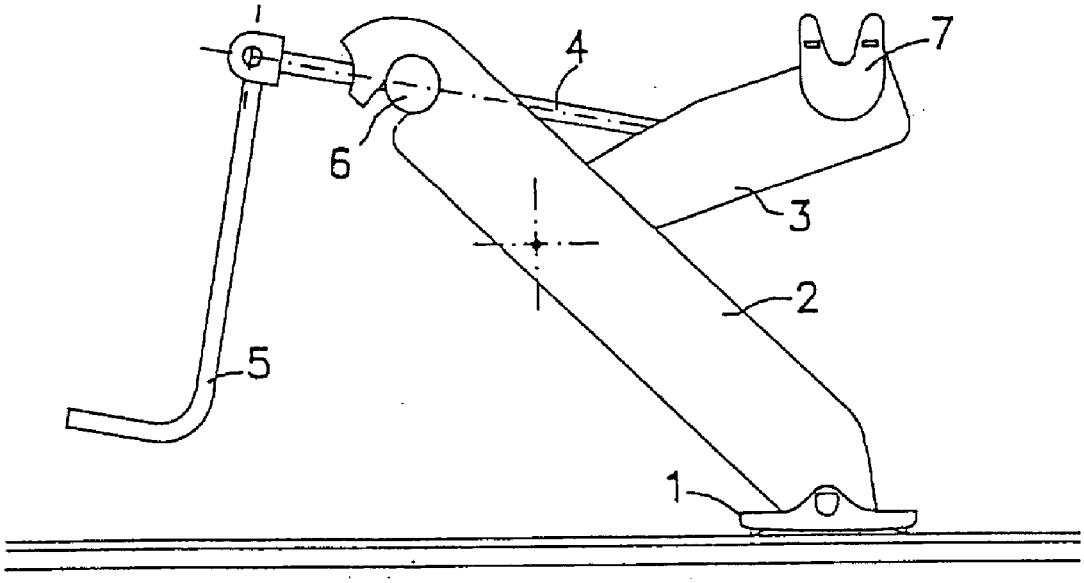
FIG. 1 is a general view of a Y-jack which incorporates the details according to the invention.

Looking now at FIG. 1, a jack is represented, of the type known as Y-jacks, with a base plate (1), body (2), arm (3) and the screw spindle (4) which is connected to the body by means of a nut (6) and with the arm by means of the cross member, not illustrated. A winding handle (5) makes the screw spindle (4) turn, so that the body (2) is raised or lowered, together with the arm (3) that turns on it, at the same time raising or lowering the holder plate (7) that receives the bodywork of the vehicle.

Figure 2:
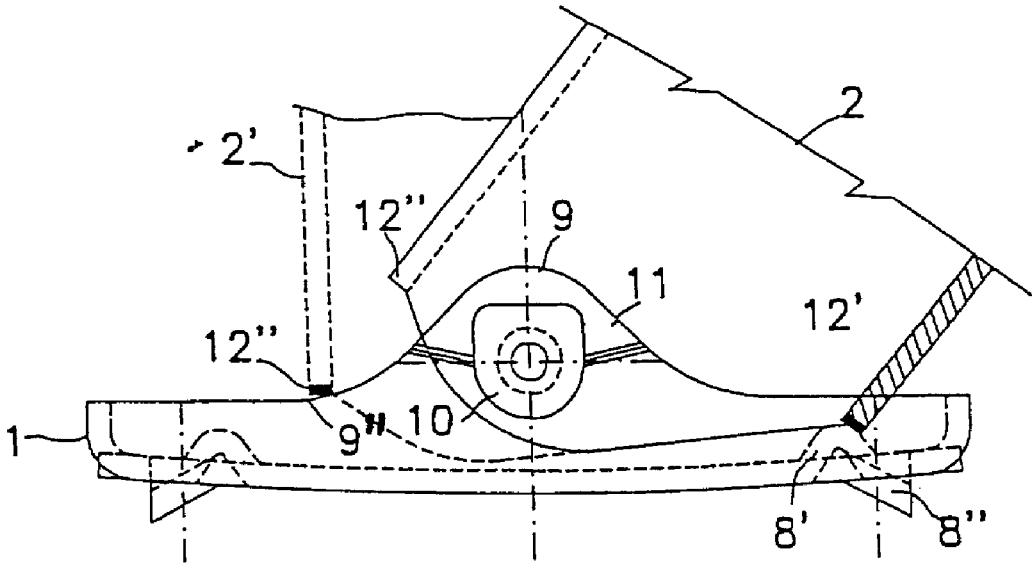
FIG. 2 is an elevation of the base plate, in accordance with the invention, in which the body is shown in the two positions, start and finish of rotation on the said base plate.
Figure 3:
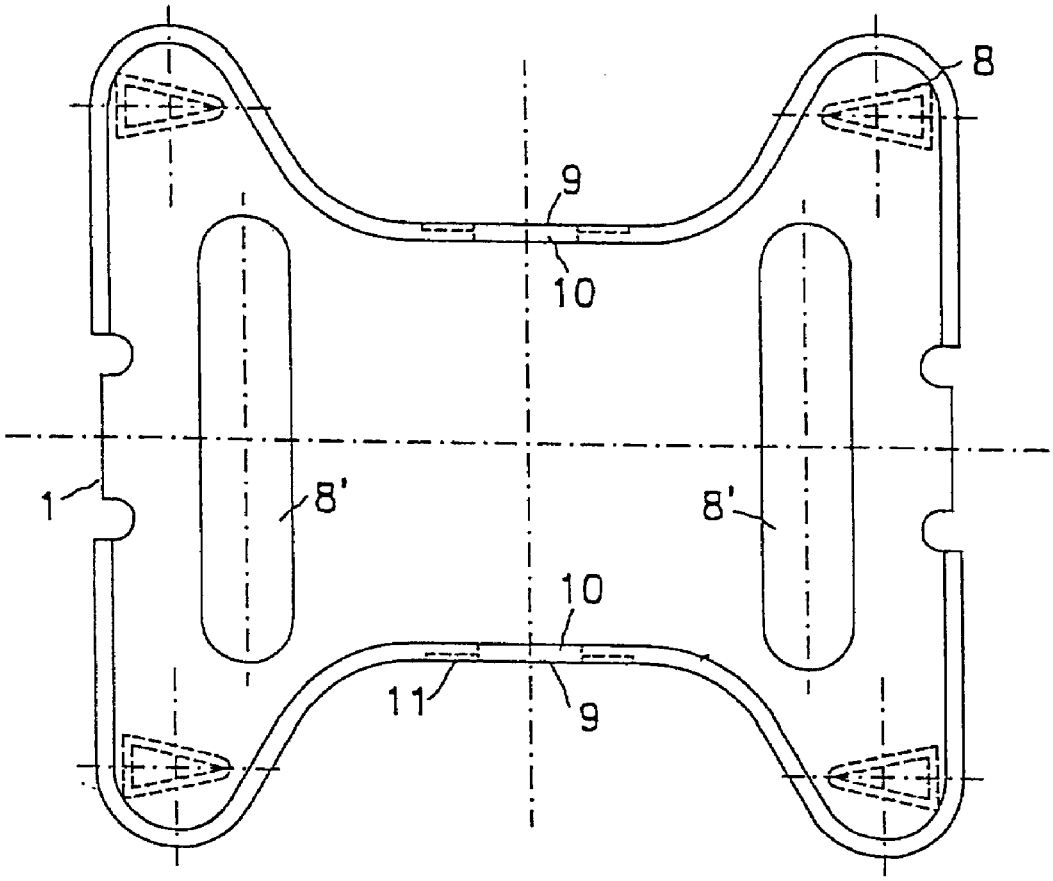
FIG. 3 is the top view of the base plate shown in FIG. 1.

As shown in FIGS. 2 and 3, the base plate (1) has four downward protuberances by way of legs (8) and projecting sides (9). The base of the base plate (1) includes the two upward protruding ribs (8') situated in a transverse direction in relation to the projecting sides (9).

The projecting sides (9) have facing perforations (10) from which the two notches (11) begin, which in the initial assembly position make the projecting sides (9) remain open with an inclination towards the exterior.

It can be appreciated in these FIGS. 2 and 3 how the base plate is perfectly symmetrical in relation to the three axes, x, y and z, with the object of facilitating the assembly of the body (2) onto it.

Figure 4:
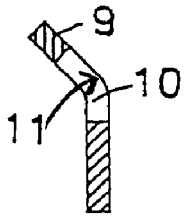
FIGS. 4 and 5 represent two views of the base plate and assembly of the body on the base plate.
Figure 5:
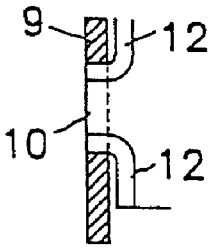

This assembly is carried out as represented in FIG. 4 and 5. FIG. 4 represents one of the projecting sides (9) when it leaves the die press; it is inclined and facilitates the insertion of the necks (12) on the body into the perforations (10) given that the notches (11) also open both perforations.

Once that the necks (12) have been housed in the perforations (10), the projecting sides (9) are bent by any conventional mechanical procedure until they are closed over the sides of the arm, as shown in FIG. 5.

As illustrated in FIG. 2, the body (2) turns between two positions. on the necks of the perforations (10). One of them in the forward area, with its end (12') butting up against the rib (8') in order to procure a certain initial inclination to the arm at the start of elevation.

The body turns on the base plate during elevation, with this turning being interrupted moments before its vertical position. In this respect, and as can be appreciated in FIG. 2, the said position is marked by (2'), with the end (12") of the body making contact and butting up against edge portions (9") of the projecting sides (9) of the base plate.

We also wish to point out, in these FIGS. 2 and 3, the particular configuration of the floor gripper legs (8") of the base plate (1). Thus, it is possible to appreciate that some partial cuts have been made in the material, which provide the end sharp edges (8") that make contact with the ground, providing a better grip for the base plate on the ground. These sharp edges (8") are positioned opposite each other in pairs, as shown, and positioned in relation to the turning axis of the body on the base plate.

Referring now to FIGS. 6, 7 and 8, these show the body (2) with the U-shaped cross section, with one end without a base, at which the two outer necks (12) are made in order to engage in the holes (10) in the base plate (1), as well as the ends (12', 12") in order to limit the turning of the body on the said base plate.

The free ends of the wings of its U-shaped section (2") are represented in schematic form in FIG. 6, for the appropriate purposes.

The right end of the body also has the two recesses (15) made in its wings in order to receive the nut (13) corresponding to the general position (6) shown in FIG. 1. The insertion of this nut is simple, as it is sufficient to simply put it into the housing.

We can observe in FIG. 8 that one of the sides of the recess (15) is oversized, and therefore because of this, its end (14) is bent towards the central portion of its surface, after the nut (13) has been inserted, to the positions (14') shown in this FIG. 8, with a simple mechanical operation.

Figure 11:
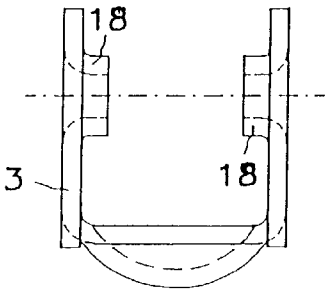
FIG. 11 represents the side view of FIG. 9.
Figure 9:
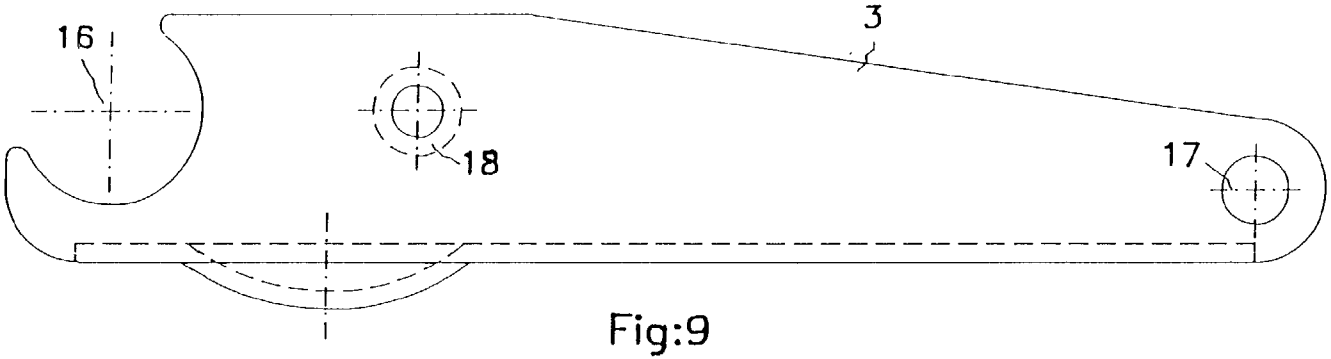
FIG. 9 is an elevation of the arm, in accordance with the invention.
Figure 10:
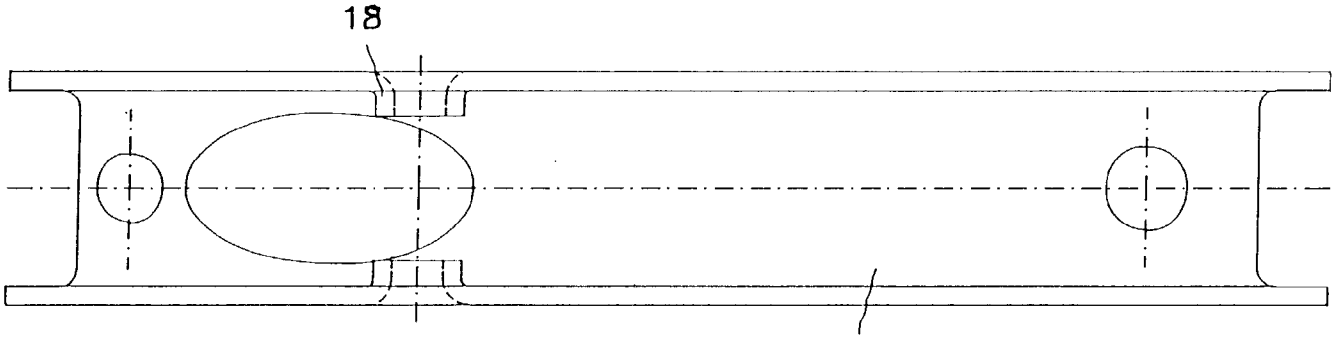
FIG. 10 corresponds to the top view of FIG. 9.
Figure 12:
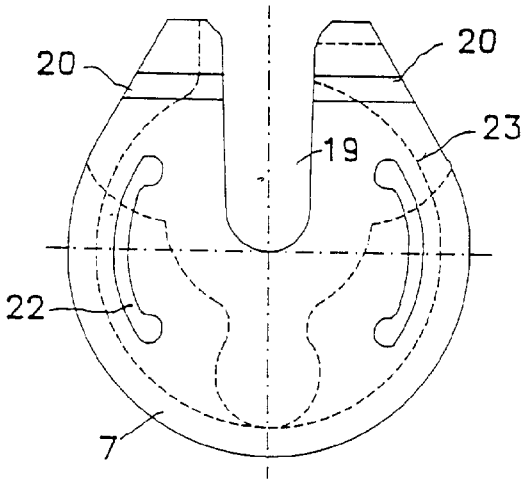
FIG. 12 shows a side view of the holder plate on the free end of the arm, in accordance with the invention.
Figure 13:
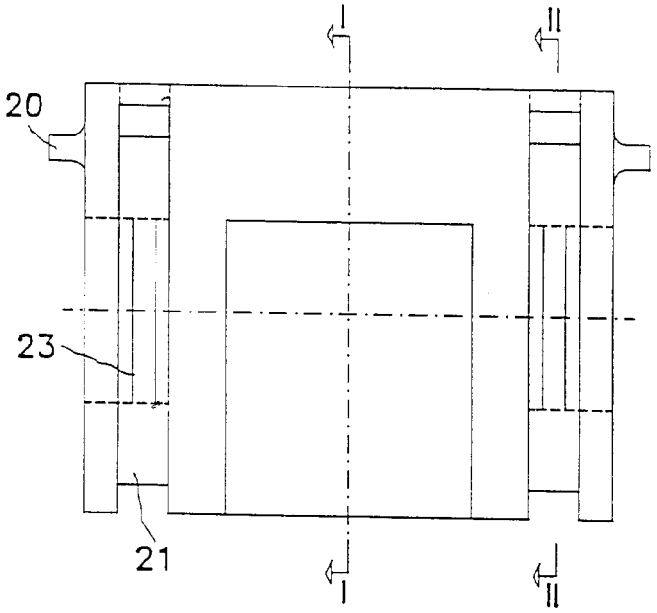
FIG. 13 is a view of the holder plate of FIG. 12, seen from the left.
Figure 14:
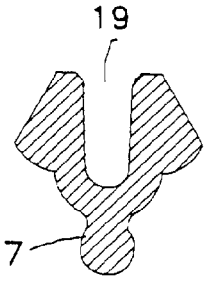
FIG. 14 shows the cross section along line I—I in FIG. 13.
Figure 15:
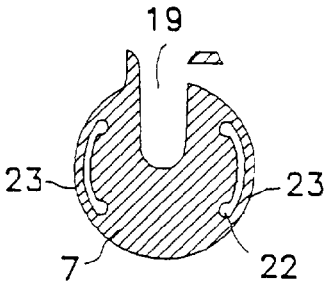
FIG. 15 is the result of the cross section along line II—II in FIG. 13.

With regard to the arm (3) shown in FIGS. 9, 10 and 11, we can point out its U-shaped cross section, with its end (17) receiving a bolt or pin for its rotation on the body (2) and with its other end occupied by the two parallel recesses (16) in order to receive the holder plate for the seating for the vehicle bodywork.

Also shown in these three figures are the two inwardly protruding necks (18) made in the material itself, with these two necks being duly facing each other and aligned. Both are responsible for receiving the cross member of the screw spindle, which will be described shortly in relation to FIGS. 16 to 20.

Figure 16:
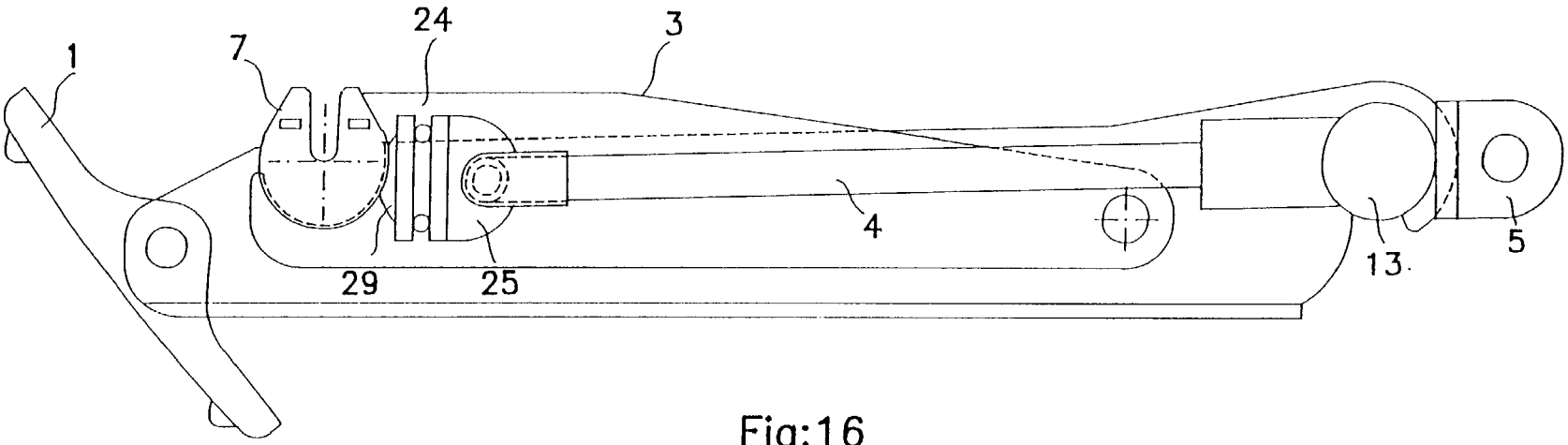
FIG. 16 shows, in schematic form, this jack of FIG. 1 in the folded position that includes the cross member.
Figure 17:
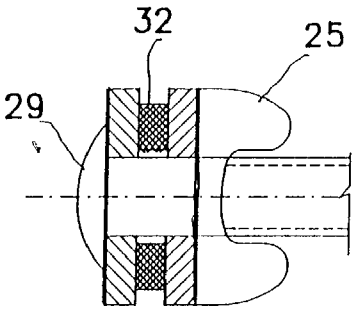
FIG. 17 is a variant of the cross member, in accordance with the invention.

According to FIGS. 16 and 17 we can observe that in the folded position of the jack, the screw spindle (4) is connected to the nut (13) and its free end is connected to the winding handle (5). The opposite end (29) of the screw spindle receives the conventional assembly of washers and ball cage (24) and on its right we can see the cross member (25), on whose left side it is supported, all of which are close to the holder plate (7).

In FIG. 17 we can observe the variant of the invention consisting of providing anti-friction material (32) between the outer washers, based, for example, on a metal plate coated with a suitable anti-friction material. This contribution to the unit simplifies the assembly and reduces costs.

Figure 18:
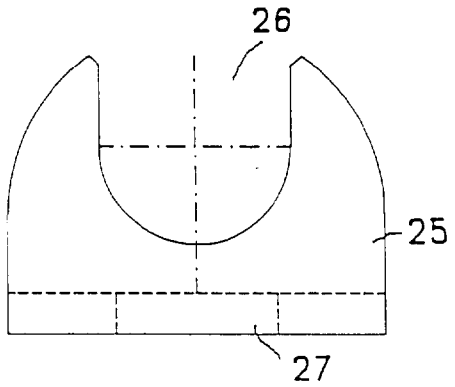
FIGS. 18 and 19 are two views of the cross member, in accordance with the invention.
Figure 19:
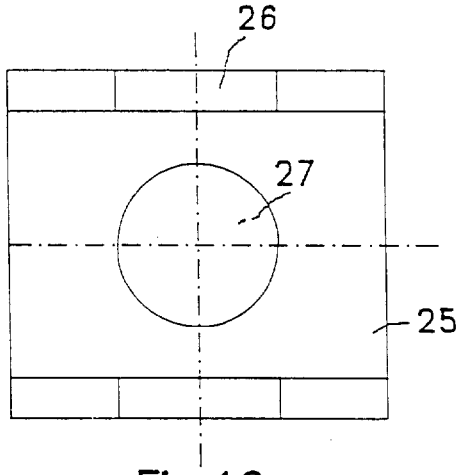
Figure 20:
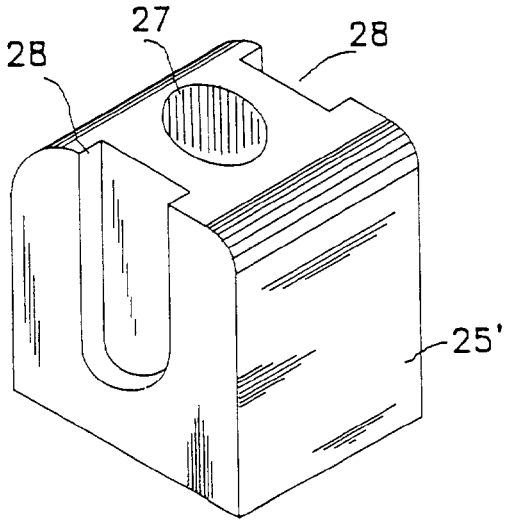
FIG. 20 represents a variant construction of the cross member, also in accordance with the invention.

The cross member itself is shown in FIGS. 18 and 19, as well as in FIG. 20. As can be appreciated, this is a part with a perforated base (27) to allow the screw spindle to pass through and with wings (25) in which U-shaped openings (26) are made, open towards the right, as illustrated in FIGS. 16 and 17.

This cross member is placed by means of the simple insertion of the wings (25) into the necks (18) of the arm, without the use of any auxiliary component or item. The end of the screw spindle is secured to the rear side of its base, as demonstrated in FIGS. 16 and 17, close to or in contact with the body of the holder plate (7), which prevents the slightest possibility that the cross member becoming detached.

A slight amount of play or tolerance of the cross member in the longitudinal direction could also be accepted, as it operates under a load, its removal is totally impossible.

Therefore its assembly is carried out in a very simple manner, while at the same time its strength is increase as compared to other conventional cross members, by virtue of the solution provided.

FIG. 20 shows a formal solution for the cross member (25), based on a monoblock part with the central hole for the passage of the screw spindle and the U-shaped side recesses (28) for the insertion of the necks on the arm.

Obviously, this cross member part can have other types of geometric shapes different from the ones mentioned, although always with the particularity of maintaining the open longitudinal side recesses (26, 28) and the perforation, logically, to allow the passage of the screw spindle.

As regards the holder plate (7), represented in FIGS. 12 to 15, we once again point out that this type of item has already been described in document EP-A-0683131, with the rotation stops themselves in the interior of the channels (21) and with the outer stops (29), for correct positioning of the holder plate, that make contact with the body of the jack when it is being folded.

In this particular case, the holder plate (7) is provided with some end longitudinal slots (22) that extend from the exterior to occupy the space of the channels (21), in a diametrically opposed position on both sides of the vertical, that run through the central cavity (19) for the seating for the bodywork.

As a result of this contribution, the insertion of the holder plate is carried out by exerting pressure on the ribs of the annular channels, which are subjected to flexing to maintain their safe fitting, as well as the stable positioning of the holder plate, for all purposes.

Figure 21:
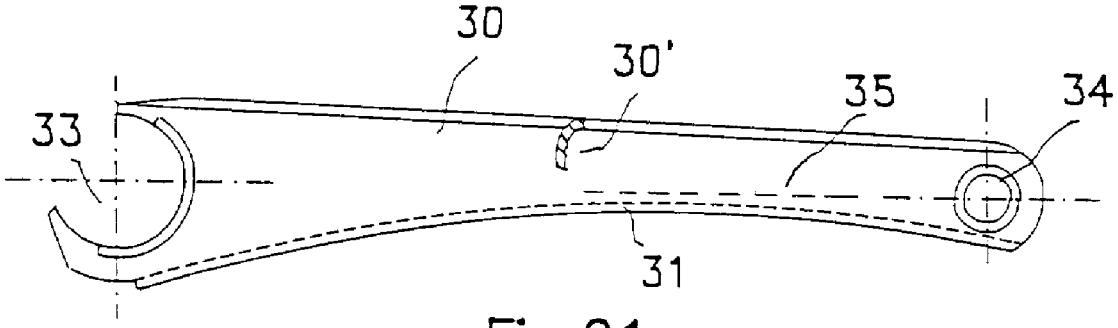
FIG. 21 is a representation of the elevation of the thin curved arm, in accordance with the invention.
Figure 22:
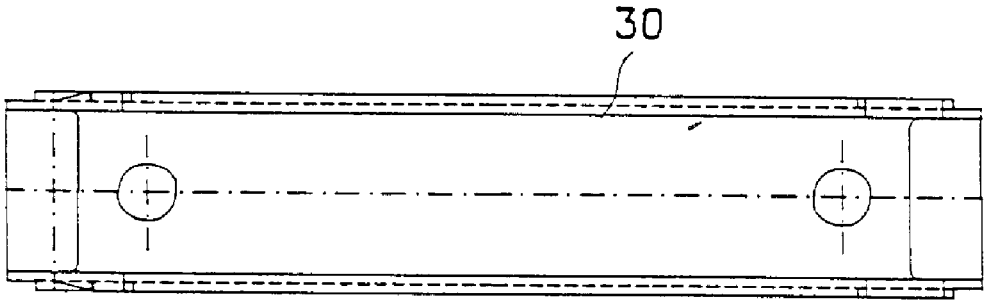
FIG. 22 is a top view of the curved arm of FIG. 21.
Figure 23:
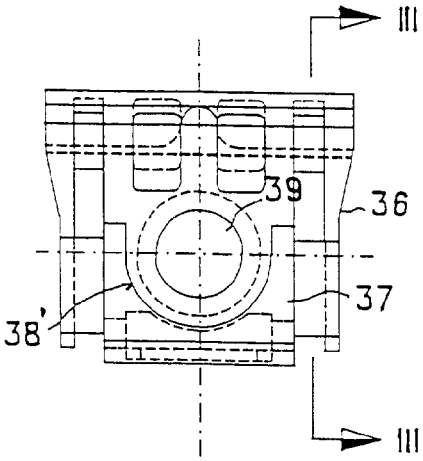
FIG. 23 represents a external front elevation of the cross member-holder plate, in accordance with the invention.
Figure 24:
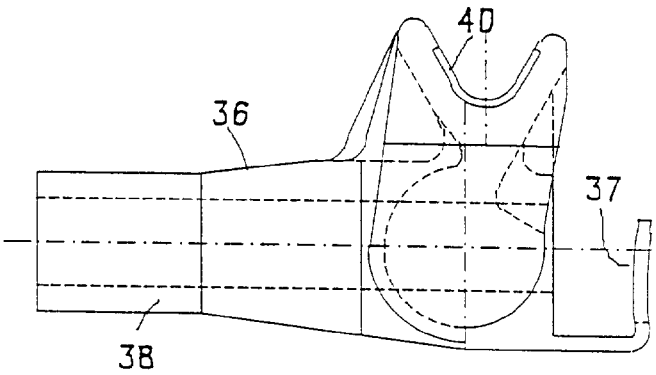
FIG. 24 shows the left view of the cross member holder plate of FIG. 23.
Figure 25:
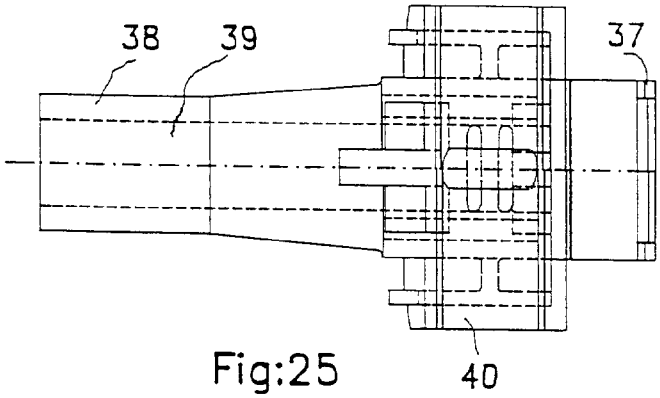
FIG. 25 is the top view of FIG. 24.
Figure 26:
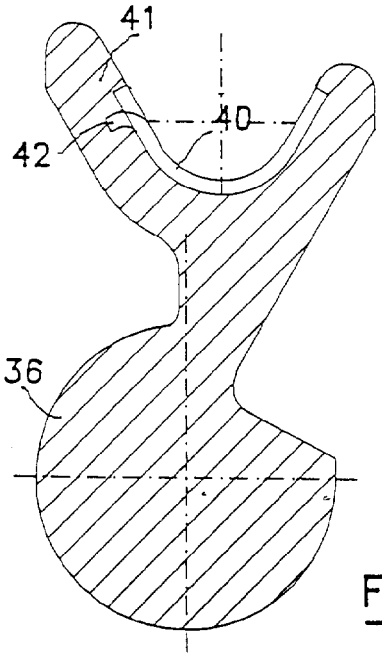
FIG. 26 is the result of the cross section along line III—III in FIG. 23.

With reference to FIGS. 21 and 22, we can appreciate the narrow arm (30) claimed by the invention, which has a U-shaped cross section and its outwardly concave curved base along its whole length, so that its central point (31) is, approximately, close to the line (35) that connects the end (34) for the rotation pin with the body (2) and the other end at which the recesses (33) are made.

The ends of the wings (30') of this arm are produced with a certain outward and upward inclination, as can be seen in the detail shown in FIG. 21.

Referring, finally, to FIGS. 23 to 26, we point out the representation of the holder plate-cross member (36), which is engaged in recess 33 of arm 30 and uses the technique described in EP-A-0697635, taking in the end of the screw spindle (4) and providing a seating by way of a holder plate.

The particularity of this holder plate-cross member (36), manufactured in suitable plastic material, lies in the provision of its outer L-shaped end (37) with its open central part (38'), to which direct access is provided for the perforation (39) that receives the screw spindle (4), which is inserted through the forward portion (38, 36).

Moreover, as the most advantageous characteristic of the invention, there is the provision of the metal insert (40) embedded in the upper area of the seating (41) for the bodywork. This insert, as illustrated, is housed in the plastic material of the holder plate-cross-member by means of items (42), such as lugs, protuberances, etc., which are inserted in order to achieve a greater security for the said insert.

By this, it is possible to prevent breakage of the holder plate-cross member, thus increasing its working life. It is important to point out, once having described the nature and advantages of this invention, its non-restrictive character, inasmuch as changes in the shape, materials or dimensions of its constituent parts will not in any way alter its essence, as long as they do not mean a substantial variation of the whole assembly.

I claim:

1. A vehicle jack comprising:

a base plate (1);

an arm;

a body (2);

a first end of said body (2) rotatably engaged to said base plate (1);

a first end of said arm (3) rotatably engaged to said body (2);

a screw spindle (4) having a first free end and a second end rotatably connecting said body (2) and said arm (3); and a winding handle (5) engaged to said first free end of said screw spindle (4) to rotate said screw spindle (4) said winding handle (5) having means to adjust a distance between said body (2) and said arm (3);

said base plate (1) having of upwardly projecting sides (9) with opposing holes (10) and ribs (8') located transversely to said projecting sides (9);

said body (2) having a U-shaped cross-section and a pair of connecting projections (12) projecting inward from sides of said body (2) at said first end thereof;

wherein said projecting sides (9) of said base plate (1) are bent away from an axis of said base plate along notches (11) on said projecting sides (9) to permit easy engagement of said pair of connecting projections (12) in a bottom of said opposing holes (10);

wherein said projecting sides (9) are bent inward along said notches (11) to engage a circumference of said projections (12) in said opposing holes (10) and secure said projections (12) in rotatable engagement with the opposing holes (10);

wherein at least one of said ribs limits rotation of said body (2) on said base plate (1) in a first direction and top edges (9") of said projecting sides (9) limit rotation of said body (2) on said base plate (1) in a second direction opposite to said first direction;

wherein a second end of said body (2) has a pair of opposing slots (15) on said sides of said body (2);

a nut (6) having a pair of grooves and threadingly receiving said screw spindle (4), edges of said slots (15) being respectively engaged in said grooves on said nut, said nut being secured in rotatable engagement in said slots (15) by bending projections (14) on said second end of said body (2) over said grooves on said nut (6);

and wherein said arm (3, 30) has a recess (16, 33) on a second free end thereof which engages a holder plate (7, 36) for a vehicle and a cross member (25, 25', 36) which rotatably engages a second end of said screw spindle (4).

2. The vehicle jack according to claim 1, wherein said base plate (1) is totally symmetrical in relation to longitudinal, traverse and vertical axes thereof.

3. The vehicle jack according to claim 1, wherein legs (8) on the base plate (1) for gripping ground are cut out of the base plate (1) to produce downwardly directed sharp edges (8").

4. The vehicle jack according to claim 1, wherein said cross-member (25, 25') is spaced away from said holder plate (9) and has a base facing the free end of said arm (3), and a second end of said screw spindle (4) passes through said base and has washers and a ball cage engaged thereon which are supported on said base and engage said holder plate (9) when said jack is folded for storage;

said washers having an anti-friction material (32) located between the washers.

5. The vehicle jack according to claim 1, wherein the arm (30) has a U-shaped cross section and a concave curvature (31) over a full length of the arm (30) and wherein a central point of the arm is close to a line that connects centers of both ends of the arm (30); and said holder plate (36) including said cross member are engaged on said arm (30) and have an L-shaped projection (37) at one end thereof, said L-shaped projection having a side (37) perpendicular to an axis of the screw spindle (4) and a semicircular slot (38') engaging a second end of said screw spindle (4) which passes through a through hole in said holder plate (36) and has washers and a ball cage fixed on said second end of said screw spindle.

6. The vehicle jack according to claim 5, wherein an upper surface of the holder plate has a metal insert (49) embedded therein and provided with ledges (42) that penetrate into said holder plate.

7. The vehicle jack according to claim 1, wherein the holder plate (7), has two slots that start from the longitudinal ends of the holder plate and extend longitudinally from an exterior to occupy the totality of two end channels (21) the slots occupying portions of an arc relative to a center of the holder plate, the portions being diametrically opposed and located on sides of the holder plate on both sides of a vertical upper recess (19), an interior of the channels having two pairs of protruding portions centered in the slots, so that the holder plate becomes directly housed and secured in the recess in the arm by pressure.

8. The vehicle jack according to claim 7 wherein said a diameter of said recess on said arm is smaller than a diameter of protruding portions of the channels in the holder plate.

9. The vehicle jack according to claim 5, wherein free edges of sides of said arm (30) are bent outward.

10. The vehicle jack according to claim 4, wherein the cross member (25) is a U-shaped part having a hole therethrough and sides having a longitudinal u-shaped cavity with a rounded base (26).

11. The vehicle jack according to claim 4, wherein the cross-member (25') has a longitudinal through hole (27) and longitudinal U-shaped recesses (28) with a rounded base on side walls thereof.

12. The vehicle jack according to claim 1, wherein said pair of ribs (8) are punched out of a bottom side of said base plate.

13. The vehicle said jack according to claim 1, wherein said pair of said connecting projections (12) are punched out from said sides of said body (2).

* * * * *